United States Patent [19]

Eisermann et al.

[11] Patent Number: 4,572,348

[45] Date of Patent: Feb. 25, 1986

[54] LOCK, PARTICULARLY A COIN-DEPOSIT LOCK

[75] Inventors: Armin Eisermann; Heinz ten Eicken; Kurt Obenlüneschloss; Diethard Geiger, all of Velbert, Fed. Rep. of Germany

[73] Assignee: Schulte-Schlagbaum Aktiengesellschaft, Velbert, Fed. Rep. of Germany

[21] Appl. No.: 551,738

[22] Filed: Nov. 10, 1983

[30] Foreign Application Priority Data

Nov. 13, 1982 [DE] Fed. Rep. of Germany ..... 3242045

[51] Int. Cl.[4] ..... G07F 17/14

[52] U.S. Cl. ..... 194/248; 70/413; 70/DIG. 41

[58] Field of Search ..... 194/4 R, 4 B, 4 C, 4 D, 194/51, 59, 65, 101; 70/276, 413, DIG. 41

[56] References Cited

U.S. PATENT DOCUMENTS

| | | | |
|---|---|---|---|
| 2,746,745 | 5/1956 | Damon | 194/4 R X |
| 2,931,953 | 4/1960 | Barney | 70/276 X |
| 3,543,904 | 12/1970 | Constable et al. | 194/4 C |
| 3,621,965 | 11/1971 | Eicken | 194/59 |

FOREIGN PATENT DOCUMENTS

| | | | |
|---|---|---|---|
| 2078845 | 1/1982 | United Kingdom | 70/276 |

*Primary Examiner*—F. J. Bartuska

*Attorney, Agent, or Firm*—Martin A. Farber

[57] ABSTRACT

A lock provides a locking function after the insertion of a coin into it. The lock includes a punch card scanner which serves to enable the lock to provide the locking function. The lock includes a moveable bolt which is responsive to the scanner and a detent-like blocking catch. Movement of the bolt toward a locked position urges an inserted coin to lift the blocking catch, thereby freeing the bolt for further movement.

15 Claims, 13 Drawing Figures

FIG. 10
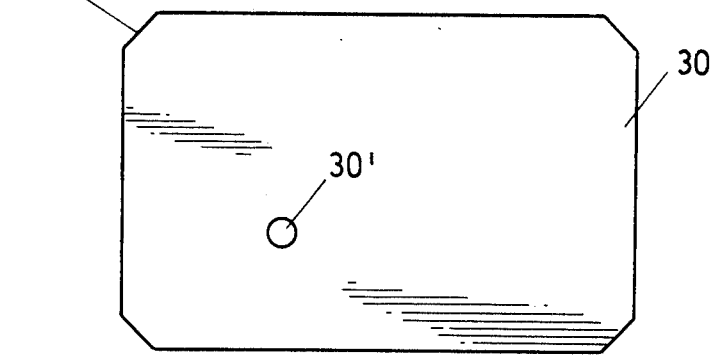
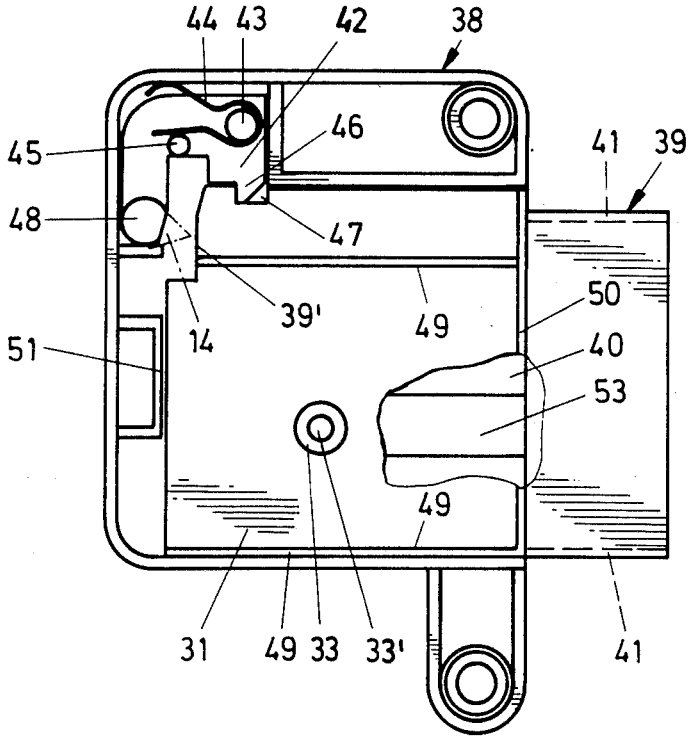
FIG.9

LOCK, PARTICULARLY A COIN-DEPOSIT LOCK

The present invention relates to a lock having a locking function which is adapted to be activated after the insertion of a coin. The coin may be retained as deposit for the key, for instance in the case of lockers in swimming establishments. The lock then has a locking function which is activated by insertion of a punch card, a bolt which is moved by means of a key into the closed position and a scanning device for the hole or holes in the punch card can be inserted into a shaft in the lock case.

The object of the present invention is so to develop a lock of this type that, while of simple construction, a variable possibility of use can be obtained while assuring a high security factor.

According to the invention a punch-card lock is provided of the type which is adapted to provide a locking function after insertion of a coin into it. The lock is provided with punch card scanning means which acts as a means for enabling the lock to provide the locking function. In this connection the lock also includes a moveable bolt which is responsive to the scanning means, and a detent-like blocking catch. Movement of the bolt toward a locked position urges an inserted coin to lift the blocking catch thereby freeing the bolt for further movement.

As a result of this development a lock of this type of increased value in use is objected. Thus, while of simple construction, effective protection against all sorts of manipulations is achieved. Furthermore, types of use which can be combined with each other or exclude each other are obtained. A magnetic pin is included in a punch-card scanning device, which, due to its physical properties, results in a saving of mechanical components and expense. Thus an axially polarized magnetic pin is supported within a bolt-side shaft wall in a manner in which it is freely displaceable in direction transverse to the displacement of the bolt. Opposite the pin there is a counter-magnet which is associated with the bolt.

The counter-magnet pulls the magnetic pin into blocking position in front of a blocking shoulder on the bolt so that the latter cannot enter into the closed position and the key cannot be withdrawn. Only upon the introduction of the specific punch card can the magnetic pin be displaced from its blocking position by the advance of the bolt. This can be advantageously effected as a result of magnetic force. In this connection the introduction of the magnetic pin into the hole in the punch card is obtained by the magnetic force of repulsion of a repulsion magnet arranged in the vicinity of the blocking shoulder. Here the poles which face each other are alike. The ejection function is important also for the pure coin version if the removable ejection magnet is to remain on the bolt. It lies in replaceable manner within a borehole in a blocking-shoulder block arranged on the wide surface of the bolt. This block is made of non-magnetizable material. The ejection magnet can, for instance, be dispensed with if in the event that the introduction of the magnetic pin into the hole of the card is by the magnetic attraction between magnetic pin and a magnetizable zone associated with the edge of the hole. Concretely, this zone may consist simply of an eye ring which surrounds the hole in the punch card. A card having a magnetizable zone, in the event of a suitable arrangement of the punch-card scanning safety, excludes punch cards without such magnetizable zone. In practice, a suitable example of distribution may reside in that a swimming establishment which is to be used by two clubs at different times can, by issuance of suitable cards, be used only by the one group and then, after suitable re-equipping, at another time only by the other group. Another variation of the card may consist of a narrow wall thickness and be free of any hole, in which case then the magnetic pin is controlled in the region of the blocking shoulder via an oblique edge. Another variation is that there is associated with the bolt a tumbler which can be lifted out by a control surface of the punch card and which can also be lifted out by the edge of a coin dropping into a pocket in the bolt. In this way the function of the conventional coin-deposit version is retained. By narrowing the punch card used, a further variation in use is established. The structural means of a supplementary device which can be associated with such coin-deposit locks are simple and suitable. In this connection, the punch-card shaft is developed as replaceable slide-in part of an attachment box mounted on the wide surface or cover of the lock case and the blocking-shoulder block extends through this cover up into the attachment box. The slide-in part makes possible, by simple means, changeover to cards of different height and different pattern. The slide-in part is fixed in position in simple manner by a spring catch formed in the manner of a latch within the attachment box. Finally, it is advantageous with respect to the intended use that an entry depression be associated with the magnetic pin on the other side of the punch-card shaft. Only upon the entrance of the magnetic pin into this depression is the blocking shoulder released upon punch-card use. The punch card can, however, also be used in favorable fashion for the indirect lifting out of the tumbler, by associating with the bolt a tumbler which can be lifted out by the control curve of a slide and which is arranged in longitudinally displaceable manner with respect to the insertion shaft of the punch card and has a lateral projection which lies in the path of insertion of the punch card. The suitable intercalation of a slide provides the advantageous possibility of using a card having a hole arranged in its longitudinal center so that it is immaterial for use whether or not the card is introduced upside down. The user need merely see to it that the hole lies in the vicinity of the end of the card to be inserted. The instructions for use are thereby substantially simplified. One structurally advantageous solution in this respect is obtained in the manner that the slide is of T shape, has two control curves and is arranged in the slide-in part which is incorporated in the attachment box and participates in the formation of the punch-card insertion shaft, the attachment box being developed symmetrically to its transverse central plane. By simply reversing this slide-in part the lock can be changed for right-hand or left-hand use. Furthermore, it is advantageous that the slide have a spring which rests against one ledge of the slide-in part and is limited in its longitudinal movement by a slot mounting. Spring loading and slot mounting see to it that the slide is normally held out of the region of the tumbler which is to be lifted out by it. Its displacement against spring force takes place only in the final phase of the insertion movement of the punch card. The slide-in part, which is enclosed reversibly in the symmetrically constructed collection box, has on its long side central openings within the region of which the control curves are located. Finally, it is also advantageous that the control curves form a steeply directed rising section. This comes into action only in the last moment of the displacement of the slide. Bending of the punch card is thus out of the question.

With the above and other objects and advantages in view, the present invention will become more clearly understood in connection with the detailed description of preferred embodiments, when considered with the accompanying drawings, of which:

FIG. 9 is an inside view of the attachment box which can be associated with the lock case and has the slide-in part forming the punch-card shaft;

FIG. 10 is a view of the punch card;

Figure 1:
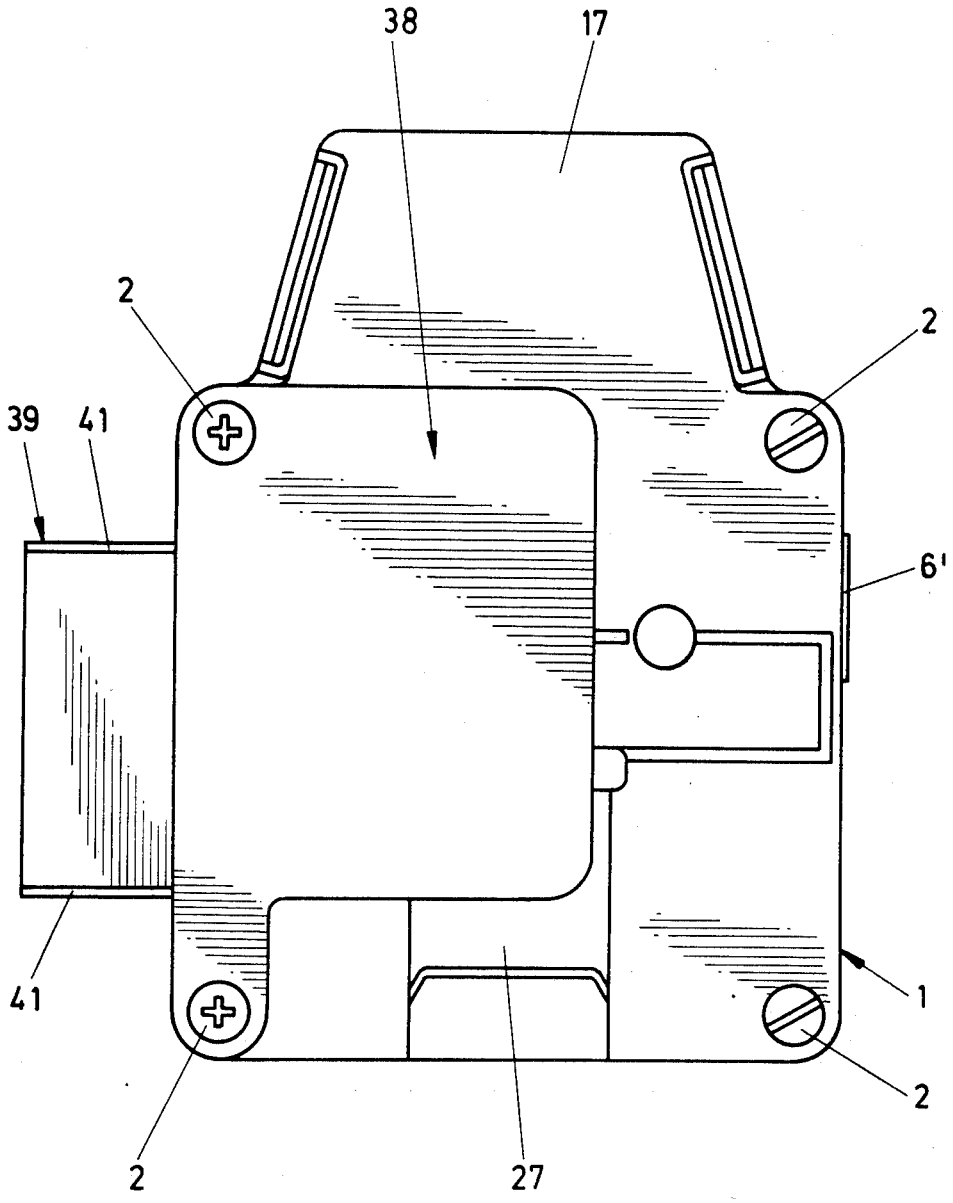
FIG. 1 is a view of a lock adapted to be fastened to the rear wall of the door of a locker or the like, with the bolt shot back.
Figure 2:
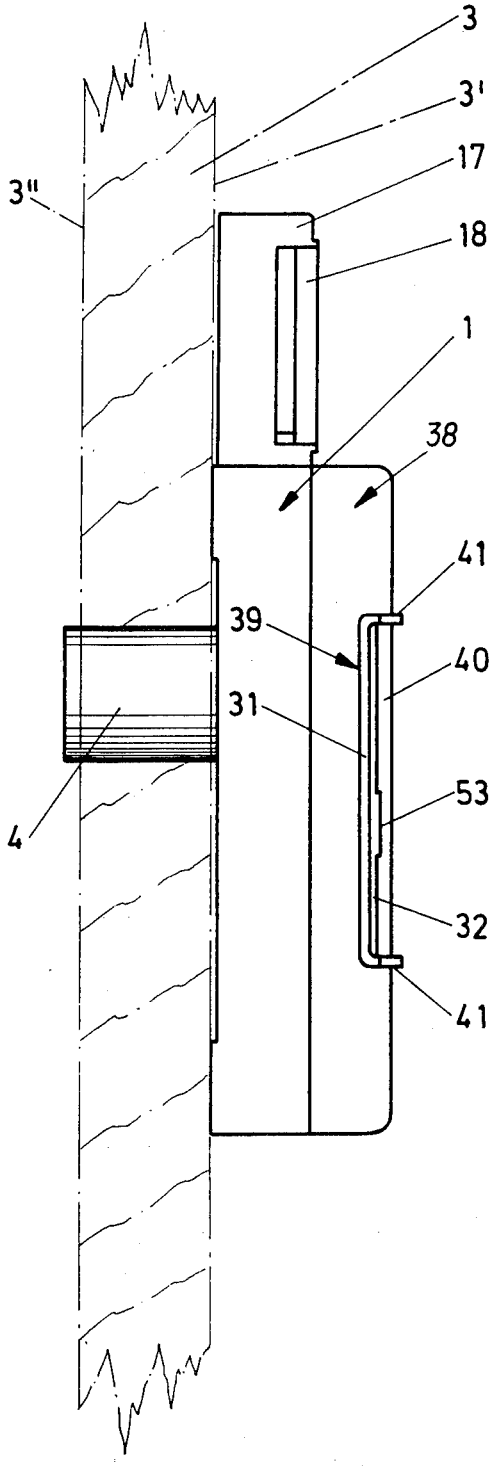
FIG. 2 is a view of FIG. 1 turned 90°, seen from the side of the punch-card shaft, the door being shown in dashed line.
Figure 3:
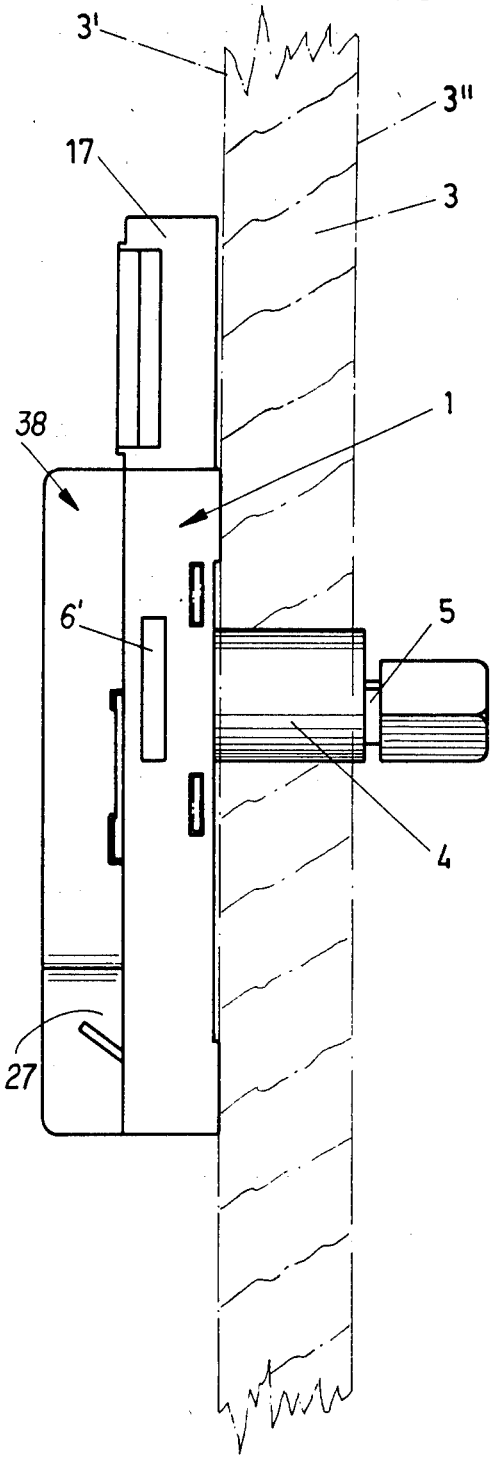
FIG. 3 is a corresponding view seen from the side of the head of the bolt.

The lock case is fastened by screws 2 to the inner side 3′ of the door 3.

A lock cylinder 4 which extends from the lock case 1 in the direction towards the door and passes through a hole in the door projects in part on the outer side 3″ of the door. Within the cylinder plug 4″ thereof there is inserted a key 5 which can be removed only when the bolt 6 is forward in the locked position and therefore the key stroke has been effected in full.

Figure 4:
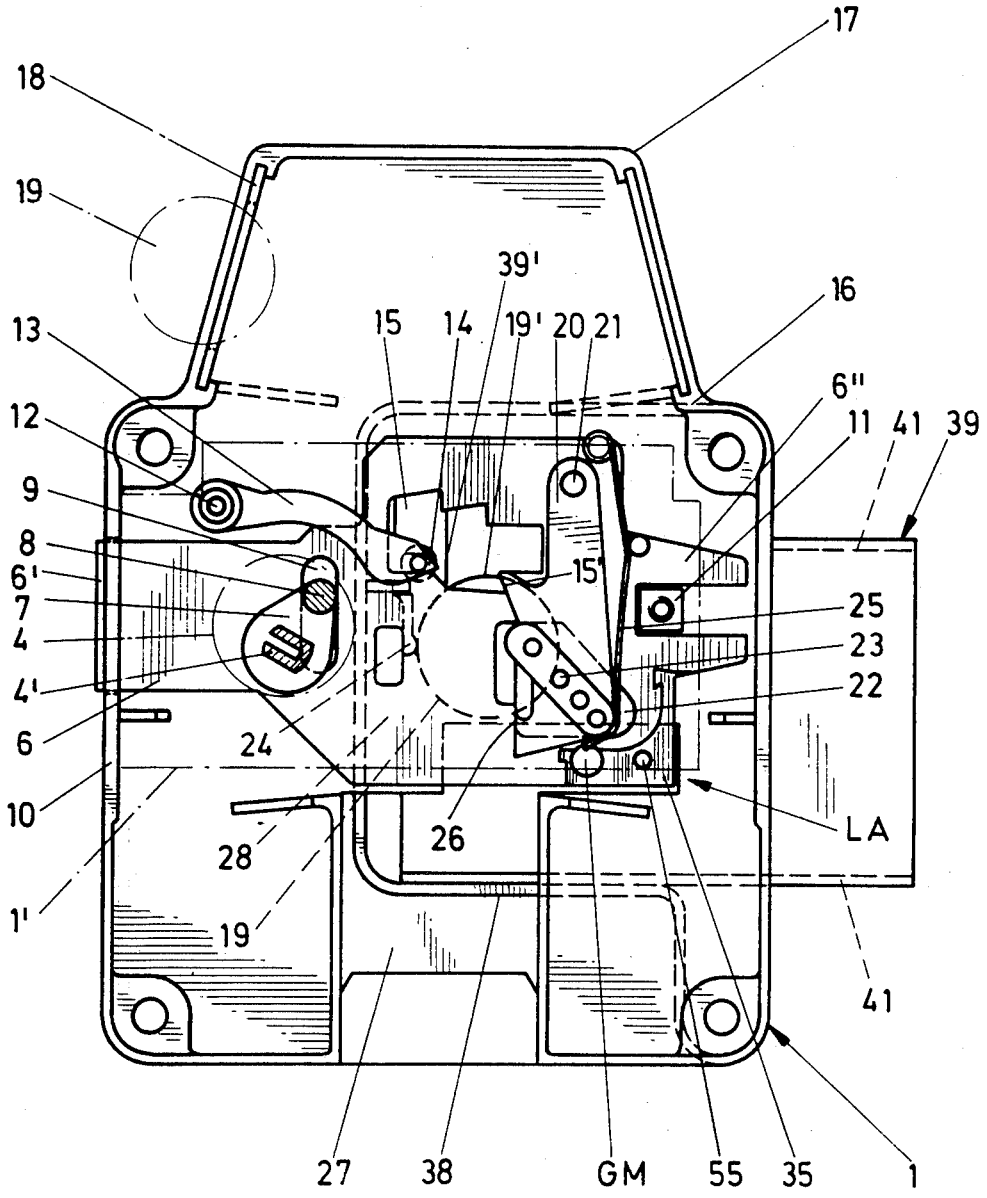
FIG. 4 is a rear view of the lock with the rear wall of the lock being shown in dashed line.
Figure 8:
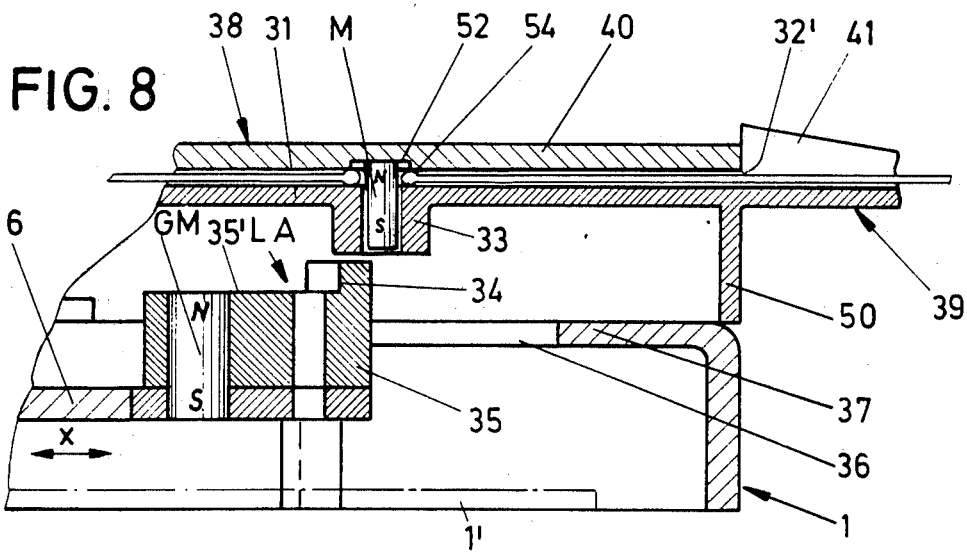
FIG. 8 is a detail view of the punch-card scanning device on a larger scale.

The lock case 1, which is formed as a partly open box, has its box opening facing in the direction of the door 3; the lock mechanism which is arranged within the lock case, is covered by a lock-case rear wall 1′ shown in dashed lines in FIGS. 4 and 8. On this wall the lock cylinder 4 is seated, its cylinder plug 4′ bearing a driver wing 7 which is rigidly attached to it. From the wing there extends a driver pin 8 which extends within a vertically directed slot 9 in the bolt 6, which is guided for horizontal displacement in the lock case. For the guidance of the bolt 6 there serves, at one end, its bolt head 6′ which passes through the lateral lock-case side-wall 10 and, on the other end, its bolt tail 6″. The latter is forked and is guided on a square pin 11 which passes through the fork slot.

Above the bolt head 6′ there is a catch-like tumbler 13 mounted swingably on a pivot pin 12 arranged on the lock-case side. The tumbler is under the action of gravity or is acted on in clockwise direction by a spring, not shown in detail.

The free end of the tumbler 13 is shaped as a blocking tooth 14 which rests in a cover-toothed window 15 of the bolt 6, namely on the lower edge of the window.

The upper side wall 16 of the lock case is continued upward to form a bulge 17. The latter forms two oblique flanks one of which is equipped for the insertion of a coin 19 by the provision of a coin insertion plate 18.

Between the rear wall 1′ of the lock case and the bolt 6, a lever 20 extends in the rearward region of the bolt 6. This lever is connected to the bolt 6; it is seated on a pin 21. The lever 20 is of single-arm construction and bears a support pin 23 which passes through a window-shaped opening 22 in the bolt 6 and extends in the direction away from the door. This support pin 23, which can be changed in position in accordance with the size of the coin, represents the first point of rest for the coin 19 and is opposite a resting point 24 on the side of the bolt. The distance between the two points is less than the diameter of the coin 19.

The lever 20 is under the action of a leaf spring 25 which urges it in the clockwise direction. A stop edge 26 on the lever 20 which extends towards the bolt cooperates with an opposing edge on the window-shaped opening 22, in this way limiting the position of the lever 20.

A spring (not shown) can furthermore be coordinated to the bolt 6, urging it into its position inside the lock. Below the bolt 6 a coin drop-out opening 27 extends within the lock case 1, it being open towards the inner side 3′ of the door 3. If the lock is to be closed with the use of a coin 19, the coin is introduced through the coin insertion plate 18. The coin then passes into the pocket 28 in the bolt 6, the pocket being limited by the support pin 23 and the resting point 24 (see FIG. 4). The bolt 6 can now be shot forward by means of the key 5 via driver wing 7 and driver pin 8. In this way the blocking tooth 14 of the tumbler 13 is lifted by the edge 19′ of the coin 19. The blocking tooth 14 thus lies outside the path of movement of a blocking shoulder 15′ of the bolt window 15. The bolt can thus be moved completely forward. Only in this completely forward position, which is not reached when the tumbler 13 is not raised, can the key 5 be withdrawn, while the coin 19 remains in per se known manner in a coin storage position of the lock case. Only upon the closing again of the bolt is it fed to the coin return opening 27 which is shaped as a coin compartment.

The forward closing of the bolt 6 is furthermore however also possible by means of a punch card 30. If the lock is to be actuatable only by means of a punch card 30, the coin insertion plate 18 will be replaced by a closure plate.

A punch-card scanning device LA is incorporated for this purpose in the lock. It has an axially polarized magnetic pin M. The latter is seated for free displacement in the direction transverse to the bolt displacement x in the bolt-side wall 31 of a punch-card shaft 32. The shaft wall 31 is continued on the bolt side into a collar 33 having the form of a guide bushing within the inside 33′ of which the cylindrical magnetic pin moves.

Figure 6:
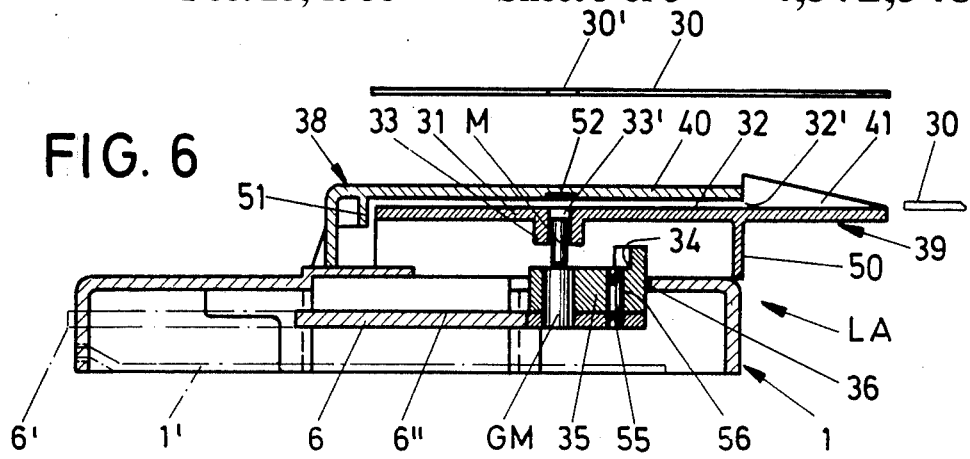
FIG. 6 is a horizontal section through the region of the bolt of the lock, primarily emphasizing the punch-card scanning device, and with a separate showing of the corresponding punch card.

A counter-magnet GM is associated with the magnetic pin M. When the bolt 6 is in its shot-back position the counter-magnet is coaxial to the magnetic pin M. The counter-magnet GM fundamentally attracts the magnetic pin M. This situation is shown in FIG. 6. Complete forward closing of the bolt 6 is not possible in this situation; similarly, the key 5 can also not be withdrawn. For this purpose the bolt is provided in the region of the punch-card scanning device LA with a blocking shoulder 34 against which the magnetic pin M strikes upon the advance of the bolt 6. The corresponding forward path is shorter than the bolt stroke which permits the locking by the key.

The counter-magnet GM, which is larger than the magnetic pin M, is seated in a blocking-shoulder block 35. The latter is made of non-magnetic material and sits in a region below the bolt tail 6''. It may be attached by being hooked into position as shown in FIG. 4. It extends beyond the tail of the bolt on the insertion-shaft side. The corresponding projection results in a radial length of support for the counter-magnet GN which is several times greater than the thickness of the bolt. The shaft-side surface 35' of the blocking-shoulder block, which surface is parallel to the stroke of the bolt, is flush with the flat end surface of the counter-magnet GM so that the corresponding end surface of the magnetic pin M can slide thereon.

The blocking-shoulder block 35 of the bolt 6 extends through an opening 36 in the wide surface or cover 37 of the lock case into an attachment box 38. This attachment box 38, which is associated on the inner side of the door with the lock case 1, is also secured by the screws 2 which hold the lock case 1 to the door 3. The attachment box can, however, also be connected, independently thereof, to the lock case so that upon the removal of the lock the shaft attachment 38 does not drop off.

The punch-card shaft 32 is formed by a slide-in part 39 of the attachment box 38. This slide-in part is of U-shaped profile in vertical direction. Its upper and lower arms extend towards the cover 40 of the attachment box 38 which limits the insertion shaft 32 towards the outside. From the insertion opening 32' the U arms widen to form guide walls 41 which taper towards the outer, free end, which facilitate the proper positioning of the punch card 30. The end of these guide walls 41 on the attachment-box side can furthermore be used for limiting the extent of insertion of the slide-in part.

The replaceable slide-in part 39 is held in the attachment box 38 by a spring catch 42 which acts in the manner of a latch (see FIG. 9). It bears a stud 43. On the latter there is seated a leaf spring 44 one leg of which rests against the corresponding wall of the attachment box while its other leg acts against a catch pin 45.

The latch nose 46 of the spring catch 42 extends into the region of the upper longitudinal edge of the plate-shaped slide-in part 39 which forms a shaft wall 31 and has a detent niche 47. The spring catch is mounted for vertical displacement. By the pushing up of the spring catch, effected against the force of the leaf spring 44, the latch nose 46 can be lifted out of the detent niche 47. For the corresponding release, the spring catch 42 has an actuation projection 48 which can be reached by a special tool and which permits, at any time, the changing of the attachment box 38 of the punch-card scanning device LA. In this way, for instance, punch card shafts of different punch-card height can be rapidly and conveniently established. On the housing side, the slide-in part 39 is continued by guide or support ledges 49 which lie in the insertion direction and extend on the outside on the cover 37 of the lock case 1. A vertical ledge 50 which is aligned with the right-hand box wall closes off the box there.

The U legs of the slide-in part 39 can extend into grooves in the cover 40 in order to avoid jamming of the punch cards 30.

The limitation of the insertion for the punch card 30 is formed by a stop 51 on the attachment box 38, this stop limiting the punch card shaft 32.

Coaxial to the opening 33' in the collar 33 there is, within the cover 40 of the attachment box 38, a cup-shaped entry depression 52 which corresponds at least to the opening 33' in the collar. This depression extends either from the cover 40 which forms the shaft wall or else from a horizontal groove 53 which is provided at the height of the hole (see FIG. 9). The purpose of this groove 53 is to assure a jam-free introduction of the punch card in the case of such punch cards 30 whose punch edge is framed by a ring eye 54 which generally protrudes somewhat laterally and which represents a magnetizable zone.

Figure 7:
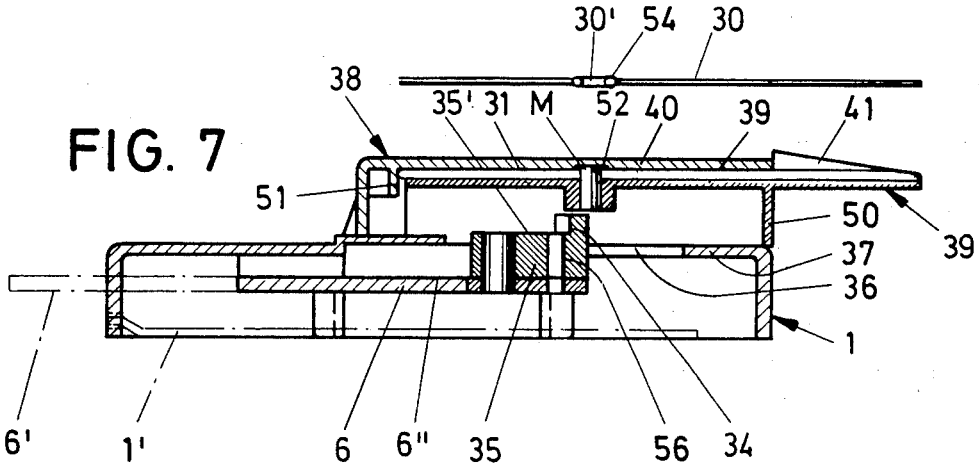
FIG. 7 is a view corresponding to FIG. 6 but also with an inserted but modified punch card, with the bolt shot forward.

Such a card having a magnetizable zone is used as a further variation for opening. This situation is shown in FIGS. 7 and 8. As can be seen, the magnetic pin M which due to the forward closing of the bolt 6 is moved out of the range of action of the counter-magnet GM has passed through the magnetizable zone, in this case through the ring eye 54, out of the region of the blocking shoulder 34. The bolt 6 can therefore be closed forward completely and the key 5 withdrawn.

Figure 5:
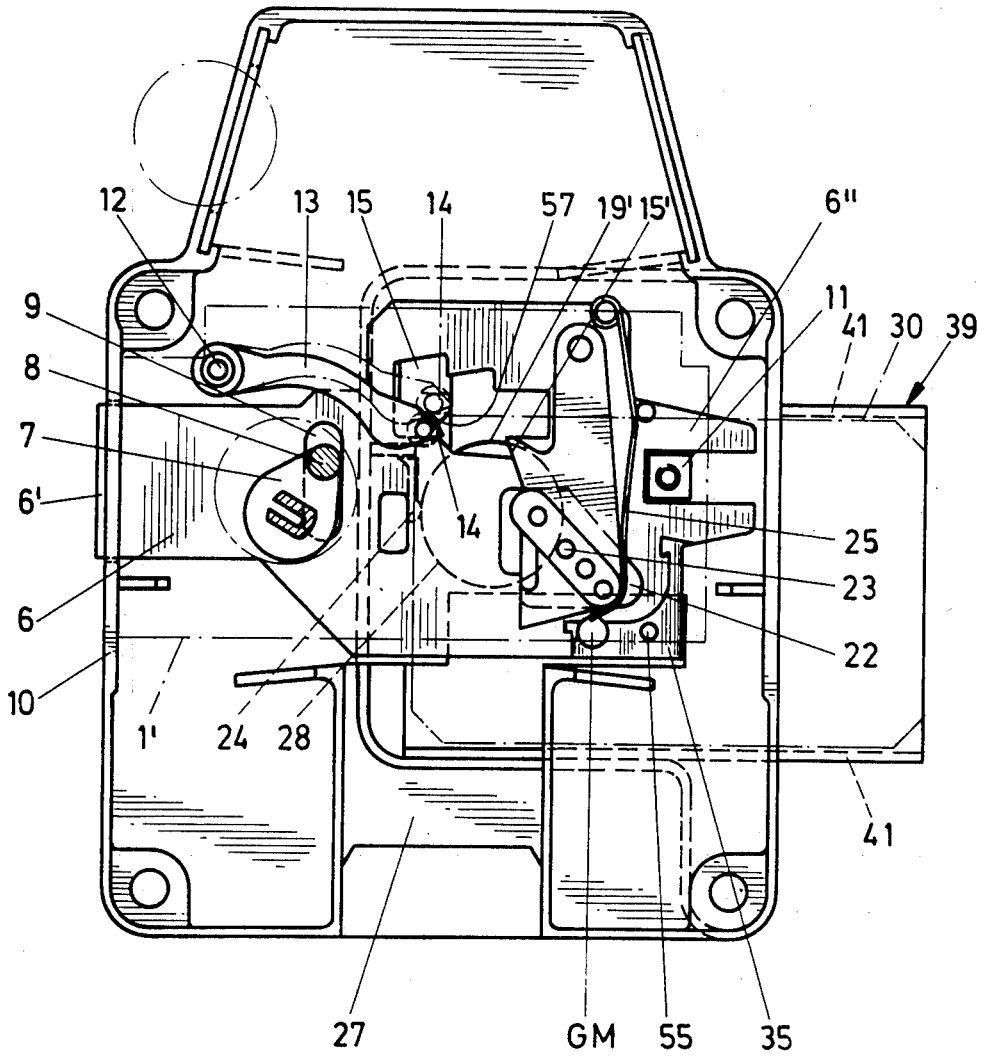
FIG. 5 is a view corresponding to FIG. 4 with the punch card inserted and the tumbler raised by it (this position is shown in dashed lines)

The variation shown in FIG. 6 indicates a different development of the card. In this case, the magnetic pin M which intercepts the bolt 6 is moved by a magnetic force of repulsion into the hole 30' of the punch card 30. The corresponding repulsion magnet is located within the region of the blocking shoulder 34. It bears the reference number 55. The opening which receives it and which is located parallel to the opening of the counter-magnet GM is designated 56. The ejection magnet 55 which is held therein by friction can, if necessary, be replaced. This variation assumes a lifting out of the tumbler 13 either by injection of a coin or by control by the punch card 30. As can be noted from FIG. 5, both situations are shown therein. The tumbler 13 is lifted up there by the upper front beveled corner of the punch card 30. The corresponding control surface of the punch card 30 is designated 57 (see FIG. 10). A niche 39' in the upper end region of the slide-in part 39 permits free passage of the tumbler blocking tooth 14 into the punch card shaft 32 so that the control surface 57 also can activate it, i.e. lift it out (see FIG. 9).

If, in the situation shown in FIG. 6, a card which is not high enough is inserted, the bolt cannot be shot forward. A card which does not have a hole 30' at the specific place also prevents the forward closure since the magnetic pin, due to application against the closed part of the card, does not pass sufficiently far out of the sphere of action of the blocking shoulder 34. The blocking shoulder therefore strikes against the magnetic pin M. In cases in which only the coin and not a card is to be used for the release of the forward closing movement of the bolt, the magnet pin must also be driven out of the region of the blocking shoulder 34.

In the case of the variation shown in FIGS. 7 and 8 in which a card with magnetizable region within the area of the hole is used, the ejection magnet 55 is not necessary, for which purpose it is coordinated in replaceable, i.e. removable, manner with the blocking-shoulder block 35.

Figure 11:
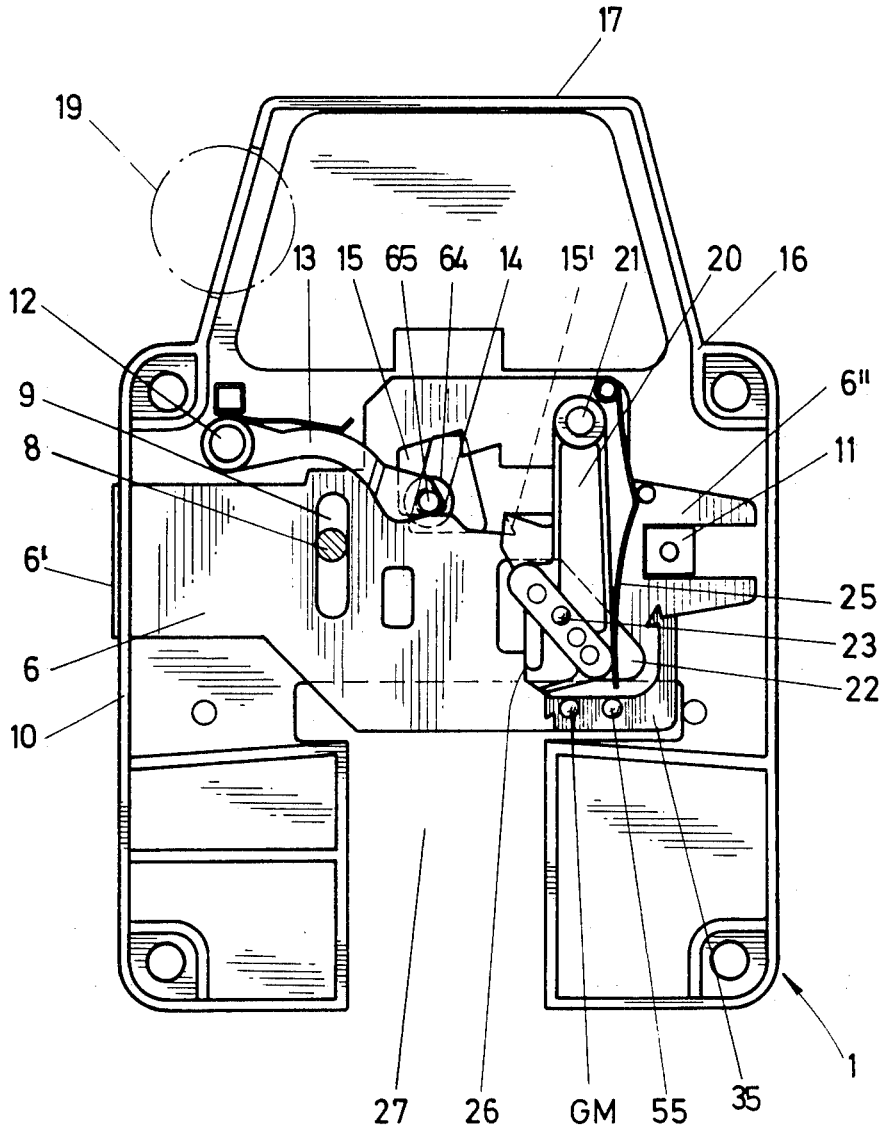
FIG. 11 shows a structural variation of the lock, seen in rear view.
Figure 12:
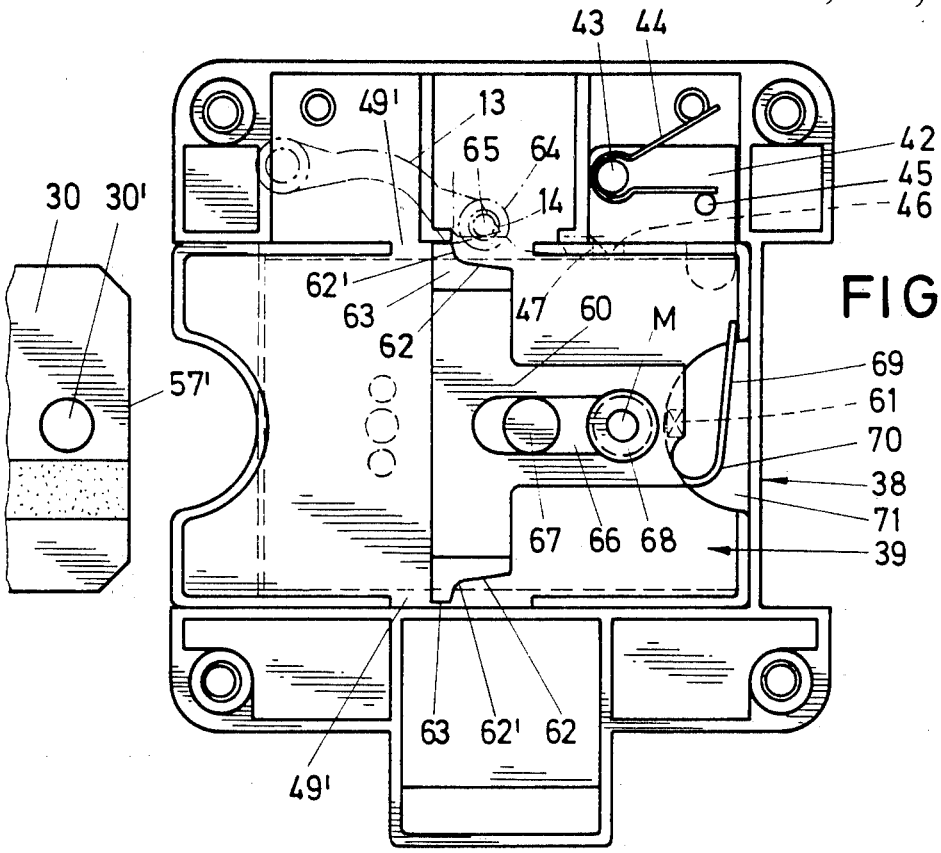
FIG. 12 is an inside view of the corresponding attachment box, which can be associated with the lock case, with inserted slide-in part cooperating in forming the punch-card shaft, with the tumbler still not lifted.
Figure 13:
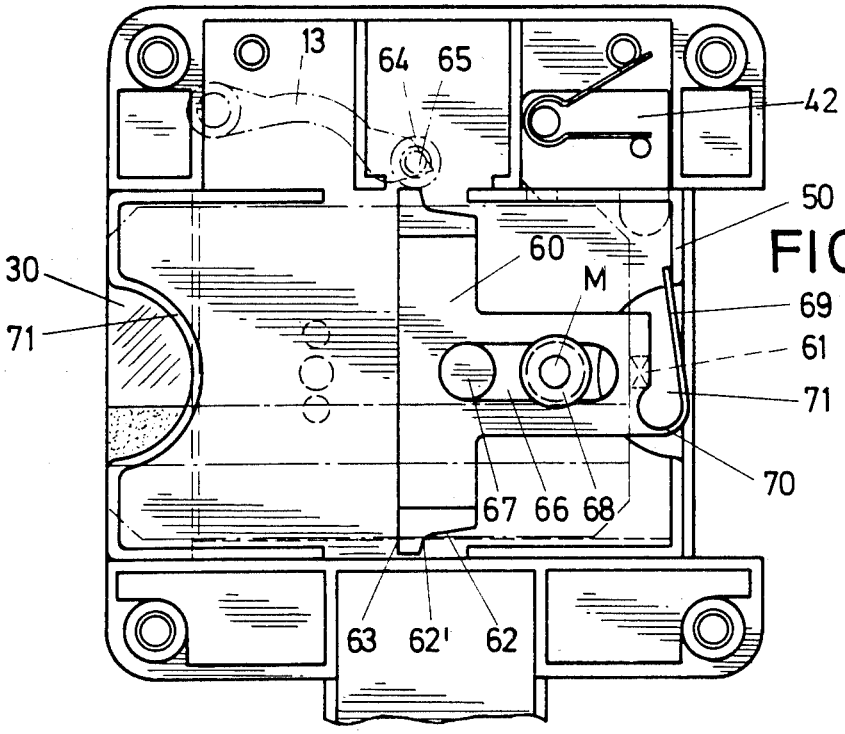
FIG. 13 is the same view with the punch card inserted and the tumbler lifted by the displaced slide.

In accordance with the embodiment shown in FIGS. 11 to 13, the lifting of the tumbler 13 is not effected directly by the punch card 30. Rather, a slide 60 is associated there with the bolt 6. This slide is situated for horizontal displacement with respect to the punch-card insertion shaft 32'. A lateral projection 61 thereof extends into the insertion path of the punch card 30. The edge lying in the direction of insertion of the punch card in this case forms the control surface 57' which cooperates with the projection 61.

The slide 60 is of T shape. Its vertically directed T arm ends have replaceable attachment pieces 63, each forming a control curve 62. The control curve 62 of the upper arm cooperates with a feeler contact roll 64 of the tumbler 13. The insertion part 39 is provided here on its long side with central openings 49' for the passage of the control curve 62. The feeler roll is seated on a horizontal transverse pin 65 which extends into the region of the control curve 62. When the bolt 6 is in the shot-back position the transverse pin 65 rests on the elevated section of the lower window edge of the bolt window 15. Upon the forward closing of the bolt the tumbler drops into a lower position so that the blocking tooth 14 of the tumbler 13 lies within the path of movement of the blocking shoulder 15' of the bolt window 15.

The slide is arranged in a slide-in part 39 which in this case also participates in the formation of the punch-card insertion shaft 32 and is incorporated in the attachment box 38, the attachment box 38 being symmetrical to its transverse central plane. In this way, the lock can be equipped or converted optionally as right-hand or left-hand lock.

The stem of the T-shaped slide 60 is used to form the stop means which limit its longitudinal movement. These means consist on the slide side simply of a horizontal slot 66 through which there pass two stationary pins 67 and 68. Their distance apart is shorter than the total length of the slot 66. The slide 60 forms a spring 69 which rests against one ledge 50 of the slide-in part 39. This spring is a leaf spring which is integrally developed thereon. It extends via a round section 70 from the free end of the stem of the T-shaped slide 60. The downward directed T arm cooperates with the tumbler 13 only after the conversion.

In the basic position the slide 60 rests against the pin 68. In this basic position the control curve 62 is out of contact with the tumbler 13. Only by the insertion of the punch card 30 into the insertion shaft 32 is this slide displaced, the control surface 57' of the punch card striking against the projection 61 which lies in the path of insertion of the card. The latter passes through a trough 71. The further displacement of the slide 60 takes place against the force of the spring 69 until the slide has come into the stop-limited position shown in FIG. 13, the arm-side end of the slot 66 coming against the stationary pin 67. In this position the tumbler 13 is lifted out. Reference is had to the dashed-line position in that figure. The feeler roller 64 there, after passing over the ascending control curve 62 and an adjacent more steeply convexly rounded ascent section 62', reaches a lift-out height which, upon the complete forward closing of the slide 6 which is now possible, prevents the blocking tooth 14 from entering into the path of movement of the blocking shoulder 15' of the bolt 15. After the complete forward closing, the key can now be withdrawn. This function has been described in detail above as well as the function of the magnet, which has been fully described.

The interposition of the slide 30 described makes it possible to position the hole 30' of the punch card 30 in the longitudinal central plane thereof, so that the user is no longer limited to a given position of the card, as would be necessary in the event that the hole were eccentric. Rather, he need merely see to it that the hole-side end of the card is introduced. The user would visually note any other use as improper since the hole would then be visible in the region of the insertion side gripping trough 71 of the slide-in part 39, also developed symmetrically, or attachment box 38. Furthermore, proper operation would be impossible due to the impossibility of the magnet through the hole 30'. Its opposing detent means are present on both sides of the plane of symmetry.

The spring catch 42 which was described in detail at the start is modified somewhat in structure without, however, a detailed description thereof being necessary. The reference numbers are employed by analogy insofar as necessary.

We claim:

1. A lock adapted to be lockable upon insertion of a punch card having a hole therein, said lock comprising:
- a lock case having a shaft for insertion therein of said punch card;
- a bolt having a blocking shoulder moveably mounted in said case;
- a counter-magnet mounted in said bolt in front of said blocking shoulder;
- a punch card scanning device including,
- an axially polarized magnetic pin moveably mounted in a bolt-side wall of said shaft for free movement transverse to movement of said bolt, wherein in an unlocked position of the bolt said counter-magnet pulls said magnetic pin into a bolt blocking position in front of said blocking shoulder; and wherein upon movement of said bolt from said unlocked position, said magnetic pin is released for movement from said blocking position into the hole in said punch card when said hole is aligned with said magnetic pin.

2. The lock according to claim 1, further comprising means for effecting the movement of said magnetic pin into the hole by magnetic force.

3. The lock according to claim 2, wherein
- said means is a magnetizable zone associated with the edge of the hole of the punch card, said zone being adapted to magnetically attract said magnetic pin, thereby introducing said pin into the hole in the punch card.

4. The lock according to claim 3, wherein
- the magnetic zone is formed of an eye ring surrounding the hole of the punch card.

5. The lock according to claim 2, wherein
- said means comprises an ejection magnet arranged in the region of the blocking shoulder of said bolt for producing a repulsive magnetic force for moving the magnetic pin into the punch card hole; and wherein said lock further includes
- a tumbler blocking said bolt and liftably mounted so as to release said blocking allowing displacement of said bolt.

6. The lock according to claim 5, wherein
- said bolt includes a blocking-shoulder block having a borehole therein arranged on a wide surface of said bolt, said ejection magnet being replaceably seated within said borehole.

7. The lock according to claim 6, wherein
- said lock case includes a cover formed as a wide surface of said case;

said lock further comprising an attachment box mounted on said cover and including a replacement slide-in part forming said shaft;

said blocking-shoulder block extends through said cover into the attachment box.

8. The lock according to claim 7, wherein said attachment box includes a spring catch forming a latch for catching said slide-in part.

9. The lock according to claim 7, further comprising a longitudinally displaceable T shaped slide arranged with the slide-in part to form the shaft for insertion of the punch card and having formed thereon two control curves and a lateral projection in the path of the punch card in the shaft, said attachment box being symmetrical to the transverse central plane of said slide; and a tumbler blocking said bolt is liftably mounted and adapted for being lifted by one said control curve to release the blocking of said bolt.

10. The lock according to claim 9, wherein said slide-in part includes a long side having a central opening therein in a region in which said control curves are located.

11. The lock according to claim 1, wherein said bolt includes a pocket adapted to accept a coin inserted into the lock;

said lock further comprising a liftably mounted tumbler, liftable by a central surface of the punch card and also liftable by an edge of the coin when the coin is positioned in the pocket of said bolt.

12. The lock according to claim 1, wherein an entry depression associated with the magnetic pin is formed in the wall of said shaft opposite the bolt-side wall.

13. The lock according to claim 1, further comprising a slide, longitudinally displaceable with respect to the shaft, and having formed thereon a control curve, and a lateral projection lying in the insertion path of the punch card in the shaft; and a liftably mounted tumbler adapted for being lifted by said control curve.

14. The lock according to claim 13, wherein said slide includes, a spring positioned for resting against a ledge of said slide-in part, and a slot mounting means for limiting lengthwise movement of said slide.

15. The lock according to claim 13, wherein a portion of said control curve is formed as a steeply rounded rising section.

* * * * *